US011341909B2

(12) United States Patent
Hua et al.

(10) Patent No.: US 11,341,909 B2
(45) Date of Patent: May 24, 2022

(54) PIXEL DRIVE CIRCUIT AND DRIVE METHOD THEREOF, AND DISPLAY DEVICE

(71) Applicants: Hefei BOE Optoelectronics Technology Co., Ltd., Anhui (CN); BOE Technology Group Co., Ltd., Beijing (CN)

(72) Inventors: Lei Hua, Beijing (CN); Jie Ling, Beijing (CN); Ran Jiang, Beijing (CN); Xiaohua Lin, Beijing (CN); Lei Qin, Beijing (CN)

(73) Assignees: Hefei BOE Optoelectronics Technology Co., Ltd., Anhui (CN); BOE Technology Group Co., Ltd., Beijing (CN)

( * ) Notice: Subject to any disclaimer, the term of this patent is extended or adjusted under 35 U.S.C. 154(b) by 323 days.

(21) Appl. No.: 16/500,578

(22) PCT Filed: Apr. 2, 2019

(86) PCT No.: PCT/CN2019/081052
§ 371 (c)(1),
(2) Date: Oct. 3, 2019

(87) PCT Pub. No.: WO2019/205905
PCT Pub. Date: Oct. 31, 2019

(65) Prior Publication Data

US 2021/0383753 A1 Dec. 9, 2021

(30) Foreign Application Priority Data

Apr. 24, 2018 (CN) ..... 201820593626.1

(51) Int. Cl.
*G09G 3/3233* (2016.01)
*G09G 3/3291* (2016.01)

(52) U.S. Cl.
CPC ..... *G09G 3/3233* (2013.01); *G09G 3/3291* (2013.01); *G09G 2300/0426* (2013.01);
(Continued)

(58) Field of Classification Search
CPC ..... G09G 3/3233; G09G 3/3208–3291; G09G 2300/0833; G09G 3/3258;
(Continued)

(56) References Cited

U.S. PATENT DOCUMENTS 9,501,170 B2 11/2016 Wu et al.
2005/0140596 A1* 6/2005 Lee ..... G09G 3/3233 345/76

(Continued)

FOREIGN PATENT DOCUMENTS

CN 103325343 A 9/2013
CN 206178518 U 5/2017
CN 208014348 U 10/2018

*Primary Examiner* — Sanjiv D. Patel
(74) *Attorney, Agent, or Firm* — Banner & Witcoff, Ltd.

(57) ABSTRACT

A pixel drive circuit, a drive method thereof and a display device are provided. The pixel drive circuit includes a writing sub-circuit, an amplification sub-circuit, and a drive sub-circuit, writing sub-circuit is configured to transmit a data voltage provided by a signal input terminal to the amplification sub-circuit under control of the scan signal terminal; the amplification sub-circuit is configured to generate an amplification electrical signal according to the data voltage and output the amplification electrical signal to a drive sub-circuit, the drive sub-circuit is configured to obtain the data voltage based on the amplification electrical signal output by the amplification sub-circuit and provide a drive current to a light-emitting device under control of the data voltage, and the light-emitting device is configured to emit light according to the drive current output by the drive sub-circuit.

19 Claims, 7 Drawing Sheets

(52) U.S. Cl.
CPC ..... *G09G 2300/0842* (2013.01); *G09G 2310/0278* (2013.01)

(58) Field of Classification Search
CPC .... G09G 2300/0842; G09G 2310/0291; H01L 27/3244
See application file for complete search history.

(56) References Cited

U.S. PATENT DOCUMENTS

| | | | | |
|---|---|---|---|---|
| 2013/0201173 | A1 | 8/2013 | Chaji et al. | |
| 2014/0168038 | A1* | 6/2014 | Kim ..... | G09G 3/3208 345/82 |

* cited by examiner

PIXEL DRIVE CIRCUIT AND DRIVE METHOD THEREOF, AND DISPLAY DEVICE

The application is a U.S. National Phase Entry of International Application No. PCT/CN2019/081052 filed on Apr. 2, 2019, designating the United States of America and claiming priority to Chinese Patent Application No. 201820593626.1, filed on Apr. 24, 2018. The present application claims priority to and the benefit of the above-identified applications and the above-identified applications are incorporated by reference herein in their entirety.

TECHNICAL FIELD

Embodiments of the present disclosure relate to a pixel drive circuit and a drive method thereof, and a display device.

BACKGROUND

Organic Light Emitting Diode (OLED) display devices are one of the hotspots in research fields. Compared with liquid crystal display (LCD) devices, OLED display devices have advantages, such as low energy consumption, low production cost, self-luminescence, wide viewing angle, high brightness, high contrast, fast response speed and the like.

A drive mode of a drive circuit of an OLED display device is different from a drive mode of a drive circuit of the LCD. The drive circuit of the OLED display device adopts a current drive mode while the drive circuit of the LCD adopts a voltage drive mode. Compared with the voltage drive mode, the current drive mode is more easily affected by a turn-on voltage of a transistor, a carrier mobility and a circuit voltage drop.

SUMMARY

Embodiments of the present disclosure provide a pixel drive circuit and a drive method thereof, and a display device.

At least some embodiments of the present disclosure provides a pixel drive circuit, which includes a writing sub-circuit, an amplification sub-circuit, and a drive sub-circuit; the writing sub-circuit is connected to a scan signal terminal, a signal input terminal and the amplification sub-circuit, and the writing sub-circuit is configured to transmit a data voltage provided by the signal input terminal to the amplification sub-circuit under control of the scan signal terminal; the amplification sub-circuit is also connected to the drive sub-circuit, and the amplification sub-circuit is configured to generate an amplification electrical signal according to the data voltage and output the amplification electrical signal to the drive sub-circuit; the drive sub-circuit is also connected to a light-emitting device, and the drive sub-circuit is configured to obtain the data voltage based on the amplification electrical signal output by the amplification sub-circuit and provide a drive current to the light-emitting device under control of the data voltage; and the light-emitting device is configured to emit light according to the drive current.

For example, in the pixel drive circuit provided by at least some embodiments of the present disclosure, the amplification sub-circuit comprises a first transistor and a second transistor; a gate electrode of the first transistor is connected to the writing sub-circuit, a first electrode of the first transistor is connected to a first voltage terminal, and a second electrode of the first transistor is connected to a first electrode of the second transistor and the drive sub-circuit; and a gate electrode of the second transistor is connected to the writing sub-circuit, a second electrode of the second transistor is connected to a second voltage terminal, and the first electrode of the second transistor is connected to the drive sub-circuit.

For example, in the pixel drive circuit provided by at least some embodiments of the present disclosure, a first voltage output by the first voltage terminal is greater than a second voltage output by the second voltage terminal, the first transistor is an N-type transistor, and the second transistor is a P-type transistor; or the first voltage output by the first voltage terminal is less than the second voltage output by the second voltage terminal, and the first transistor is the P-type transistor and the second transistor is the N-type transistor.

For example, in the pixel drive circuit provided by at least some embodiments of the present disclosure, an absolute value of the first voltage is identical to an absolute value of the second voltage.

For example, in the pixel drive circuit provided by at least some embodiments of the present disclosure, an absolute value of a threshold voltage of the first transistor is identical to an absolute value of a threshold voltage of the second transistor.

For example, in the pixel drive circuit provided by at least some embodiments of the present disclosure, the amplification sub-circuit further comprises a first diode and a second diode; a first electrode of the first diode is connected to the gate electrode of the first transistor, and a second electrode of the first diode is connected to the writing sub-circuit; and a first electrode of the second diode is connected to the writing sub-circuit, and a second electrode of the second diode is connected to the gate electrode of the second transistor.

For example, in the pixel drive circuit provided by at least some embodiments of the present disclosure, a forward conduction voltage of the first diode is identical to the absolute value of the threshold voltage of the first transistor; and a forward conduction voltage of the second diode is identical to the absolute value of the threshold voltage of the second transistor.

For example, in the pixel drive circuit provided by at least some embodiments of the present disclosure, the amplification sub-circuit further comprises a first resistor and a second resistor; a first terminal of the first resistor is connected to the first voltage terminal, and a second terminal of the first resistor is connected to the first electrode of the first diode; and a first terminal of the second resistor is connected to the second electrode of the second diode, and a second terminal of the second resistor is connected to the second voltage terminal.

For example, in the pixel drive circuit provided by at least some embodiments of the present disclosure, the writing sub-circuit comprises a third transistor; and a gate electrode of the third transistor is connected to the scan signal terminal, a first electrode of the third transistor is connected to the signal input terminal, and a second electrode of the third transistor is connected to the amplification sub-circuit.

For example, in the pixel drive circuit provided by at least some embodiments of the present disclosure, the drive sub-circuit comprises a storage capacitor and a fourth transistor; a storage capacitor is configured to obtain and store the data voltage based on the amplification electrical signal output by the amplification sub-circuit; and the fourth transistor is configured to provide the drive current to the light-emitting device under control of the data voltage.

For example, in the pixel drive circuit provided by at least some embodiments of the present disclosure, a first terminal of the storage capacitor is connected to the amplification sub-circuit to receive the amplification electrical signal, and a second terminal of the storage capacitor is connected to a third voltage terminal; and a gate electrode of the fourth transistor is connected to the amplification sub-circuit and the first terminal of the storage capacitor, a first electrode of the fourth transistor is connected to the third voltage terminal, and a second electrode of the fourth transistor is connected to the light-emitting device.

For example, in the pixel drive circuit provided by at least some embodiments of the present disclosure, the light-emitting device comprises a light-emitting diode; and an anode of the light-emitting diode is connected to the drive sub-circuit, and a cathode of the light-emitting diode is connected to a fourth voltage terminal.

At least some embodiments of the present disclosure also provide a display device, which includes any one of the pixel drive circuits described herein above.

At least some embodiment of that present disclosure also provide a drive method of the pixel drive circuit described in any one of the above embodiments, which includes: in a data writing stage, writing the data voltage into the amplification sub-circuit, generating the amplification electrical signal by the amplification sub-circuit based on the data voltage, writing the amplification electrical signal into the drive sub-circuit, and obtaining the data voltage based on the amplification electrical signal by the drive sub-circuit; and in a light-emitting stage, driving the light-emitting device to emit light by the drive sub-circuit based on the data voltage.

BRIEF DESCRIPTION OF THE DRAWINGS

In order to clearly illustrate the technical solutions of the embodiments of the present disclosure, the drawings of the embodiments will be briefly described in the following; it is obvious that the described drawings are only related to some embodiments of the present disclosure and thus are not limitative to the present disclosure. For those of ordinary skill in the art, other drawings can be obtained according to these drawings without creative labor.

DETAILED DESCRIPTION

Figure 1:
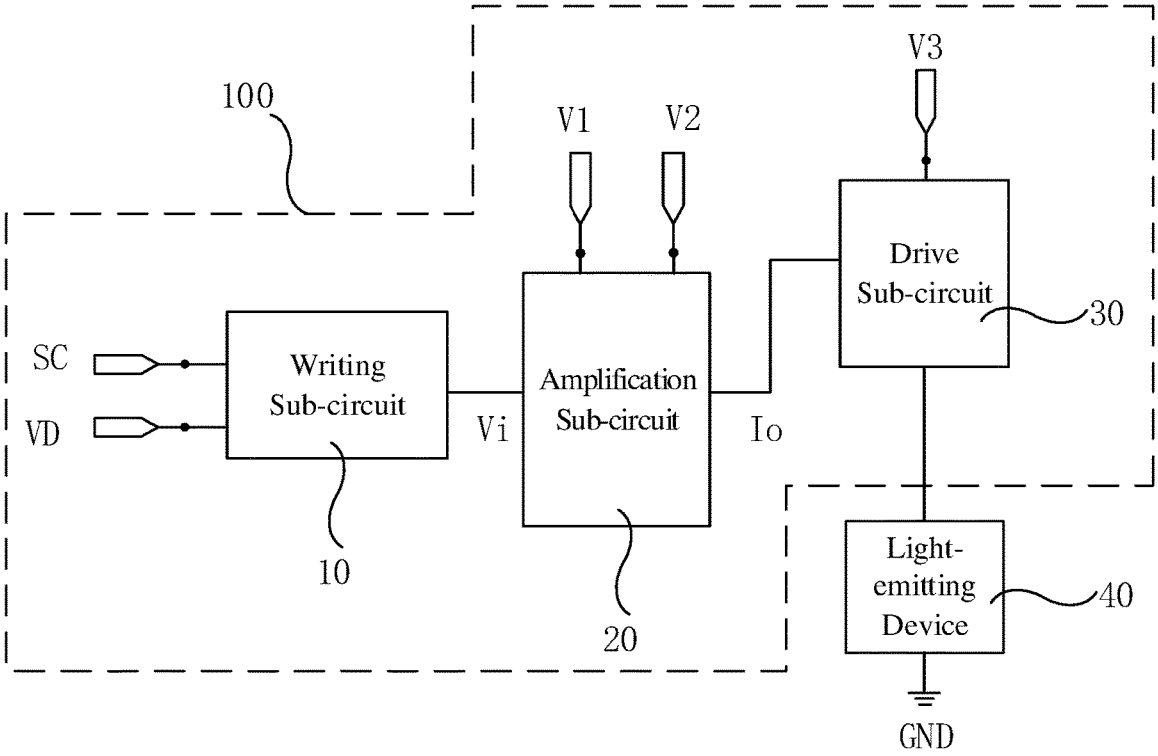
FIG. 1 is a structural schematic diagram of a pixel drive circuit provided by some embodiments of the present disclosure.

In order to make objects, technical details and advantages of the embodiments of the present disclosure apparent, the technical solutions of the embodiments will be described in a clearly and fully understandable way in connection with the drawings related to the embodiments of the present disclosure. Apparently, the described embodiments are just a part but not all of the embodiments of the present disclosure. Based on the described embodiments herein, those skilled in the art can obtain other embodiment(s), without any inventive work, which should be within the scope of the present disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. Also, the terms such as "a," "an," etc., are not intended to limit the amount, but indicate the existence of at least one. The terms "comprise," "comprising," "comprise," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may comprise an electrical connection, directly or indirectly. "On," "under," "right," "left" and the like are only used to indicate relative position relationship, and when the absolute position of the object which is described is changed, the relative position relationship may be changed accordingly.

Each sub-pixel of the OLED display device is provided with a pixel drive circuit and an OLED device, and the pixel drive circuit can generate a drive current for driving the OLED device to emit light according to a data voltage which is input. However, in a case where the above data voltage is smaller, a charging time of the storage capacitor in the pixel drive circuit is longer, thus reducing a response speed of the OLED device and further affecting a quality of the product.

At least some embodiment of that present disclosure provide a pixel drive circuit and a drive method thereof, and a display device. In the pixel drive circuit, a writing sub-circuit can write a data voltage into an amplification sub-circuit firstly, then the amplification sub-circuit obtains an amplification electrical signal based on the data voltage, and then the amplification electrical signal is transmitted to a drive sub-circuit and charges, for example, a storage capacitor in the drive sub-circuit. In this case, the writing sub-circuit provides an amplified electrical signal, which is identical or approximately identical to a waveform of the data voltage, to the storage capacitor in the drive sub-circuit, through the amplification sub-circuit, according to a variation rule of the data voltage, that is, an electrical signal (e.g., a current signal) provided to the storage capacitor can be amplified by the amplification sub-circuit, so that the storage capacitor is directly charged with the amplification electrical signal, thus shortening the charging time of the storage capacitor, and solving the problem that the charging time of the storage capacitor is longer in a case where the data voltage provided by the writing sub-circuit is smaller.

Embodiments of the present disclosure and examples thereof will be described in detail below with reference to the accompanying drawings.

Figure 2:
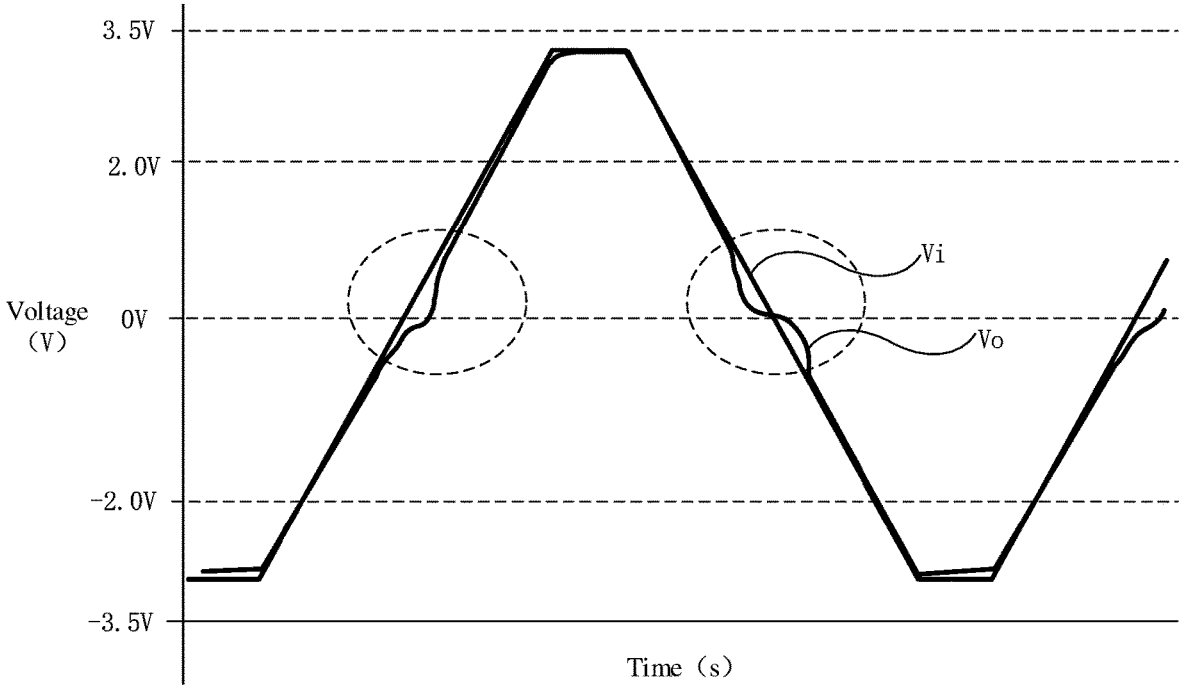
FIG. 2 is a waveform comparison diagram of a voltage input to a storage capacitor and a voltage generated on the storage capacitor.
Figure 3:
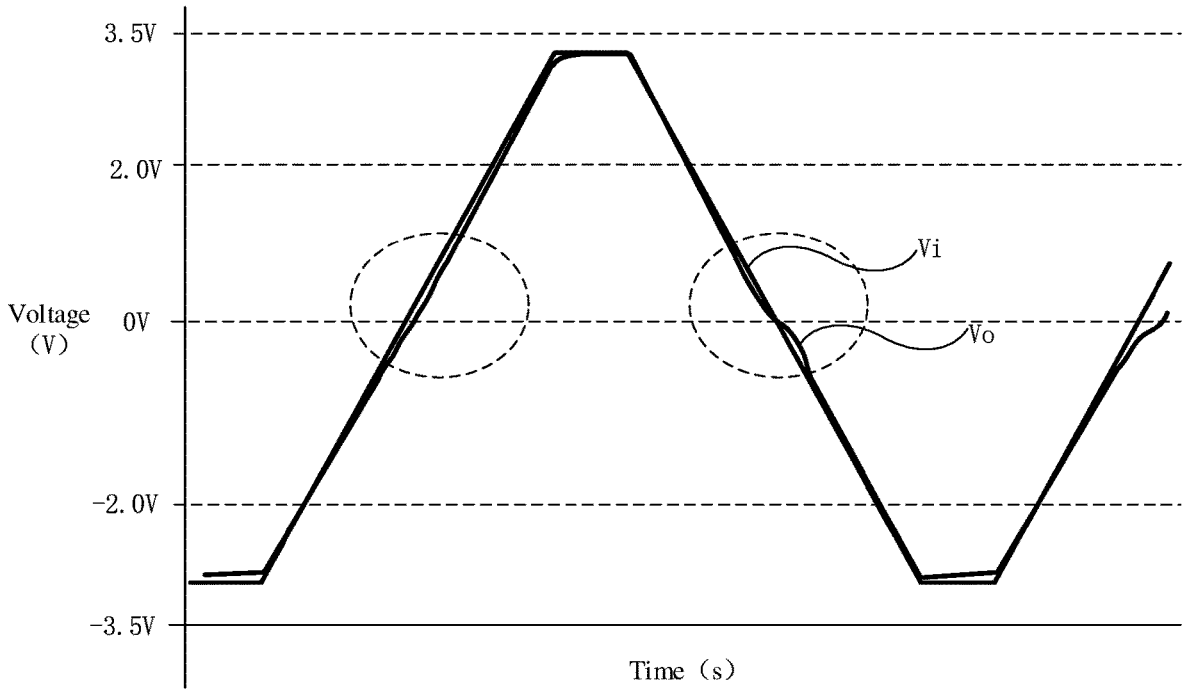
FIG. 3 is a waveform comparison diagram of a voltage input to a storage capacitor and a voltage generated on the storage capacitor provided by some embodiments of the present disclosure.
Figure 4:
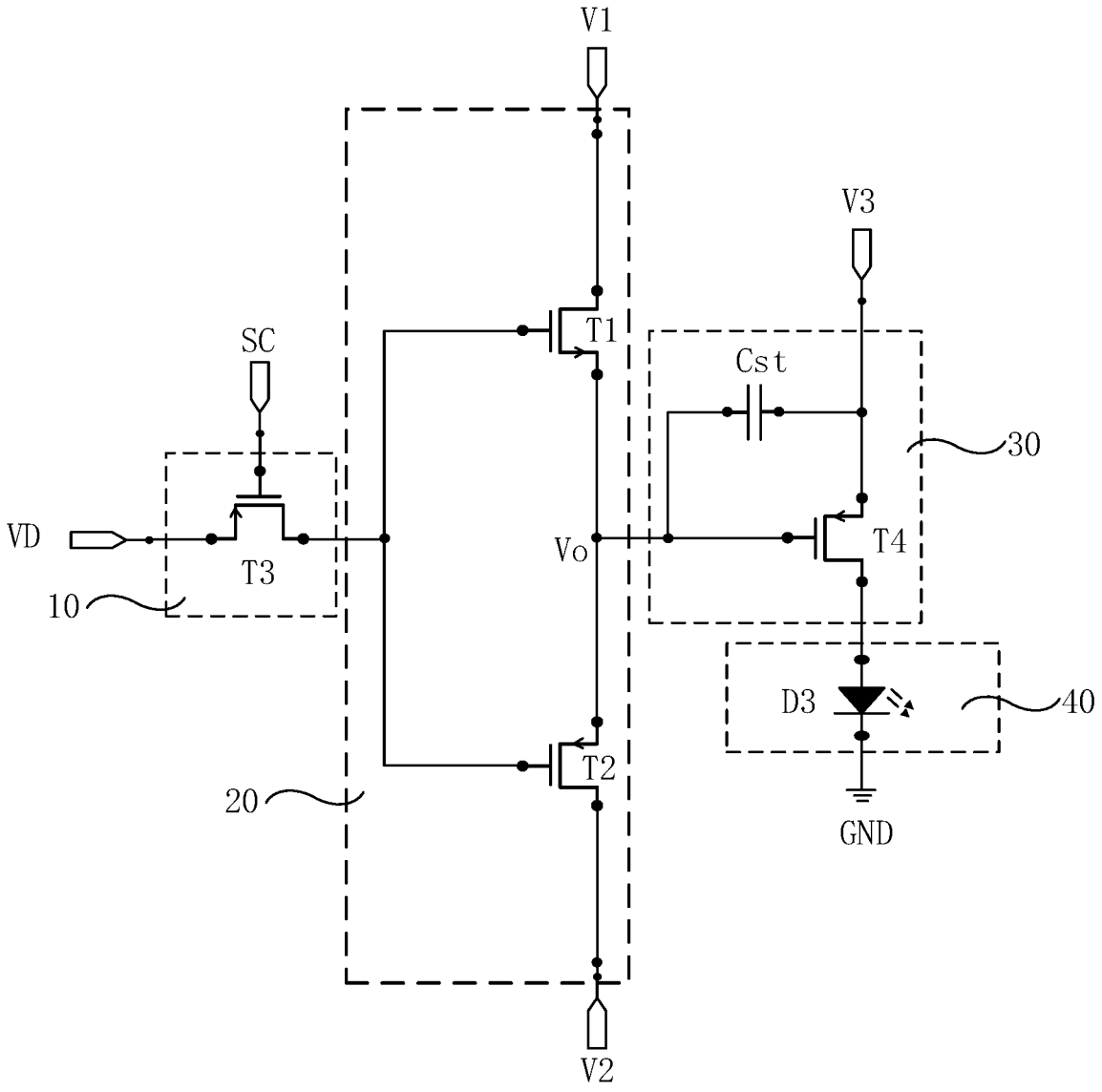
FIG. 4 is a schematic diagram of a circuit structure of a pixel drive circuit provided by some embodiments of the present disclosure.

At least some embodiments of the present disclosure provide a pixel drive circuit. FIG. 1 is a structural schematic diagram of a pixel drive circuit provided by some embodiments of the present disclosure. FIG. 2 is a waveform comparison diagram of a voltage input to a storage capacitor and a voltage generated on the storage capacitor; FIG. 3 is a waveform comparison diagram of a voltage input to a storage capacitor and a voltage generated on the storage capacitor provided by some embodiments of the present disclosure; and FIG. 4 is a schematic diagram of a circuit structure of a pixel drive circuit provided by some embodiments of the present disclosure.

For example, as shown in FIG. 1, the pixel drive circuit 100 includes a writing sub-circuit 10, an amplification sub-circuit 20, and a drive sub-circuit 30. The pixel drive circuit 100 is configured to drive the light-emitting device 40 to emit light.

For example, the writing sub-circuit 10 is connected to a scan signal terminal SC, a signal input terminal VD, and the amplification sub-circuit 20. The writing sub-circuit 10 is configured to transmit a data voltage Vi provided by the signal input terminal VD to the amplification sub-circuit 20 under control of a scan signal provided by the scan signal terminal SC.

For example, the amplification sub-circuit 20 is also connected to the drive sub-circuit 30. The amplification sub-circuit 20 is configured to generate an amplification electrical signal Io according to the data voltage Vi output from the writing sub-circuit 10, and output the amplification electrical signal Io to the drive sub-circuit 30.

For example, as shown in FIG. 1, the amplification sub-circuit 20 is also connected to a first voltage terminal V1 and a second voltage terminal V2. For example, the amplification electrical signal Io may be generated according to a DC voltage output from the first voltage terminal V1 or a DC voltage output from the second voltage terminal V2.

For example, the first voltage terminal V1 may output a constant first voltage VDD while the second voltage terminal V2 may output a constant second voltage VSS. For example, the first voltage VDD and the second voltage VSS are both DC voltages.

For example, the first voltage VDD is reverse to the second voltage VSS, that is, if the first voltage VDD is a positive voltage, then the second voltage VSS is a negative voltage, and accordingly, if the first voltage VDD is a negative voltage, then the second voltage VSS is a positive voltage. An absolute value of the first voltage VDD output from the first voltage terminal V1 is identical to an absolute value of the second voltage VSS output from the second voltage terminal V2.

For example, the drive sub-circuit 30 is also connected to the light-emitting device 40, and the drive sub-circuit 30 is configured to obtain the data voltage Vi based on the amplification electrical signal Io output by the amplification sub-circuit 20, and provided a drive current to the light-emitting device 40 under control of the data voltage Vi.

For example, the drive sub-circuit 30 is also connected to a third voltage terminal V3. It should be noted that the third voltage terminal V3 can output a constant third voltage VCC, which is also a DC voltage.

For example, as shown in FIG. 4, the drive sub-circuit 30 may include a storage capacitor Cst, which is configured to obtain and store the data voltage Vi based on the amplification electrical signal Io output by the amplification sub-circuit 20.

For example, a first terminal of the storage capacitor Cst is connected to the amplification sub-circuit 20 to receive the amplification electrical signal Io, and a second terminal of the storage capacitor Cst is connected to the third voltage terminal V3. For example, a first terminal of the light-emitting device 40 is connected to the drive sub-circuit 30, a second terminal of the light-emitting device 40 is connected to a fourth voltage terminal VBB, and the fourth voltage terminal VBB is, for example, a grounded terminal GND, that is, a cathode of the light-emitting device 40 is connected to the grounded terminal GND, and the light-emitting device 40 is configured to emit light according to the drive current output by the drive sub-circuit 30.

For example, as shown in FIG. 4, the light-emitting device 40 may include a light-emitting diode D3 or the like. The light-emitting diode D3 may be an organic light-emitting diode or a quantum dot light-emitting diode (QLED). In this case, the first terminal of the light-emitting device 40 includes an anode of the light-emitting diode D3, the second terminal of the light-emitting device 40 includes a cathode of the light-emitting diode D3, that is, the anode of the light-emitting diode D3 is connected to the drive sub-circuit 30, and the cathode of the light-emitting diode D3 is connected to the grounded terminal (GND).

As can be seen from the above, in the pixel drive circuit provided by the present disclosure, the writing sub-circuit 10 can write the data voltage Vi provided by the signal input terminal VD into the amplification sub-circuit 20 firstly. The amplification sub-circuit 20 can generate the amplification electrical signal Io according to the above data voltage Vi, and transmit the amplification electrical signal Io to the drive sub-circuit 30 to charge the storage capacitor Cst in the drive sub-circuit 30.

In this case, the writing sub-circuit 10 provides an amplification electrical signal Io, which corresponds to the data voltage Vi, to the storage capacitor in the drive sub-circuit 30 through the amplification sub-circuit 20, according to the variation rule of the data voltage Vi, that is, the electric signal provided to the storage capacitor Cst can be amplified through the amplification sub-circuit 20, so that the storage capacitor Cst is directly charged through the amplification electrical signal, thereby shortening the charging time of the storage capacitor Cst, and solving the problem that the charging time of the storage capacitor Cst is longer in a case where the data voltage provided by the writing sub-circuit 10 is smaller.

For example, as shown in FIG. 2, in a case where the writing sub-circuit 10 directly writes the data voltage Vi to the drive sub-circuit 30, and in a cash where the data voltage Vi is smaller, for example, a value of the voltage is about 0.1 to 0.4 V, a waveform of the voltage Vo (i.e., the voltage generated on the storage capacitor Cst of the drive sub-circuit 30) received by the drive sub-circuit 30 has a significant delay (an imaginary coil as shown in FIG. 2) compared with a waveform of the data voltage Vi. Therefore, the charging time of the storage capacitor Cst in the drive sub-circuit 30 is prolonged, and the response speed of the light-emitting device 40 connected to the drive sub-circuit 30 is further affected.

In addition, in a case where the writing sub-circuit 10 inputs the data voltage Vi, which passes through the amplification sub-circuit 20, to the drive sub-circuit 30, under amplification action of the amplification sub-circuit 20, the amplification electrical signal, which is generated by a DC voltage terminal, for example, the first voltage terminal V1 or the second voltage terminal V2, directly charges the storage capacitor in the drive sub-circuit 30, according to the variation rule of the data voltage (Vi), so that the charging time of the storage capacitor is greatly reduced. In this case, as shown in FIG. 3, even the data voltage Vi is smaller, for example, the value of the voltage is about 0.1 to 0.4 v, the waveform of the voltage Vo received by the drive sub-circuit 30 has no significant delay (an imaginary coil as shown in FIG. 3) compared with the waveform of Vi, thereby reducing the charging time of the storage capacitor in the drive sub-circuit 30 and further improving the response speed of the light-emitting device 40 connected to the drive sub-circuit 30.

The specific structure of each sub-circuit in the pixel drive circuit as shown in FIG. 1 will be described in detail below with reference to FIG. 4.

For example, as shown in FIG. 4, in some examples, the amplification sub-circuit 20 may include a first transistor T1 and a second transistor T2.

For example, a gate electrode of the first transistor T1 is connected to the writing sub-circuit 10, a first electrode of the first transistor T1 is connected to the first voltage terminal V1, and a second electrode of the first transistor T1 is connected to a first electrode of the second transistor T2 and the drive sub-circuit 30.

A gate electrode of the second transistor T2 is connected to the writing sub-circuit 10, a second electrode of the second transistor T2 is connected to the second voltage terminal V2, and the first electrode of the second transistor T2 is connected to the drive sub-circuit 30.

For example, in a case where the first voltage VDD output from the first voltage terminal V1 is greater than the second voltage VSS output from the second voltage terminal V2, that is, in a case where the first voltage VDD is a positive voltage and the second voltage VSS is a negative voltage, the first transistor T1 may be an N-type transistor and the second transistor T2 may be a P-type transistor; or in a case where the first voltage VDD output from the first voltage terminal V1 is less than the second voltage VSS output from the second voltage terminal V2, that is, in a case where the first voltage VDD is a negative voltage and the second voltage VSS is a positive voltage, the first transistor T1 may be a P-type transistor and the second transistor T2 may be an N-type transistor.

For convenience of explanation, the following are described by taking a case that the first transistor T1 is an N-type transistor and the second transistor T2 is a P-type transistor as an example.

In addition, an operation characteristic parameter of the first transistor T1 may be identical to an operation characteristic parameter of the second transistor T2, that is, an absolute value of a threshold voltage of the first transistor T1 may be identical to an absolute value of a threshold voltage of the second transistor T2. For example, the absolute value of the threshold voltage of the first transistor T1 and the absolute value of the threshold voltage of the second transistor T2 may both be IVthl.

In this case, under control of the data voltage Vi input by the signal input terminal VD, one of the first transistor T1 and the second transistor T2 may be in an amplification region (e.g., a linear amplification region) and the other may be in an off region, for example. The transistor in the amplification region may generate the amplification electrical signal based on the data voltage Vi and output the amplification electrical signal to the drive sub-circuit 30, thereby charging the storage capacitor Cst in the drive sub-circuit 30.

For example, in a case where the data voltage Vi input by the signal input terminal VD is greater than the absolute value of the threshold voltage of the first transistor T1, i.e., $Vi>|Vth|$, for example, the first transistor T1 may operate in the amplification region, and at this time, the second transistor T2 operates in the off region. In a case where the data voltage Vi input by the signal input terminal VD is less than a negative value of the absolute value of the threshold voltage of the second transistor T2, i.e., $Vi<-|Vth|$, for example, the second transistor T2 may operate in the amplification region, and at this time, the first transistor T1 operates in the off region.

In a case where the data voltage Vi input by the signal input terminal VD is within a range of $(-|Vth|, |Vth|)$, i.e., $-|Vth|<Vi<|Vth|$, the first transistor T1 and the second transistor T2 are both in the off region, so that the amplification sub-circuit 20 has no signal output, and a waveform of the amplification electrical signal output by the amplification sub-circuit 20 is distorted, i.e., crossover distortion phenomenon occurs.

Figure 5:
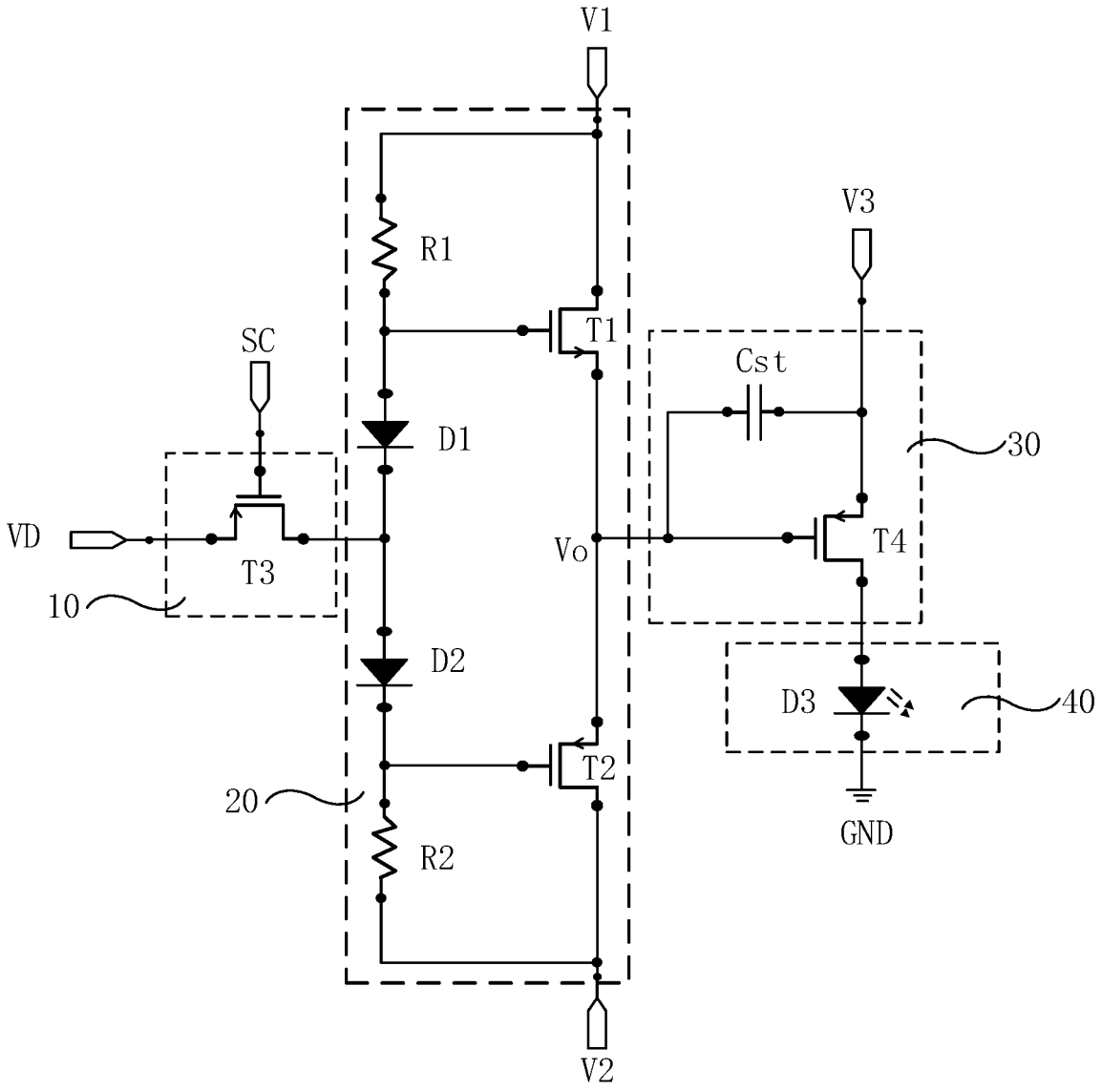
FIG. 5 is a schematic diagram of a circuit structure of another pixel drive circuit provided by some embodiments of the disclosure.

In order to solve the above problems, in other technical solutions provided by the present disclosure, as shown in FIG. 5, the amplification sub-circuit 20 may further include a first diode D1 and a second diode D2.

For example, a first electrode of the first diode D1 is connected to the gate electrode of the first transistor T1, and a second electrode of the first diode D2 is connected to the writing sub-circuit 10.

A first electrode of the second diode D2 is connected to the writing sub-circuit 10, and a second electrode of the second diode D2 is connected to the gate electrode of the second transistor T2.

For example, the second electrode of the first diode D2 is also connected to the first electrode of the second diode D2.

For example, the first electrode of the first diode D1 is an anode of the first diode D1, and the second electrode of the first diode D1 is a cathode of the first diode D1. The first electrode of the second diode D2 is an anode of the second diode D2, and the second electrode of the second diode D2 is a cathode of the second diode D2.

For example, a forward conduction voltage of the first diode D1 is identical to the absolute value of the threshold voltage of the first transistor T1. In addition, a forward conduction voltage of the second diode D2 is identical to the absolute value of the threshold voltage of the second transistor T2. At this time, in a case where the absolute value of the threshold voltage of the first transistor T1 is identical to the absolute value of the threshold voltage of the second transistor T2, the forward conduction voltage of the first diode D1 is identical to the forward conduction voltage of the second diode D2.

In this case, the threshold voltage of the first transistor T1 can be cancelled by the first diode D1, so that the data voltage Vi input by the signal input terminal VD does not needed to be greater than the absolute value of the threshold voltage of the first transistor T1, but in a case where the data voltage Vi is greater than zero, the first transistor T1 can be in the amplification region. Similarly, the threshold voltage of the second transistor T2 can be cancelled by the second diode D2, so that the data voltage Vi input by the signal input terminal VD does not needed to be less than the amplitude of the absolute value of the threshold voltage of the second transistor T2, but in a case where the data voltage Vi is less than zero, and the second transistor T2 can be in the amplification region. That is, in the example shown in FIG. 5, in a case where the data voltage Vi input to the signal input terminal VD is greater than zero, i.e., Vi>0, the first transistor T1 may operate in the amplification region, and at this time, the second transistor T2 operates in the off region. In a case where the data voltage Vi input by the signal input terminal VD is less than zero, i.e., Vi<0, the second transistor T2 may operate in the amplification region, and at this time, the first transistor T1 operates in the off region.

Therefore, the problem of crossover distortion in the amplification sub-circuit 20 (i.e., push-pull circuit) as shown in FIG. 4 can be solved.

For example, the amplification sub-circuit 20, as shown in FIG. 5, may further include a first resistor R1 and a second resistor R2, which are used for filtering.

For example, a first terminal of the first resistor R1 is connected to the first voltage terminal V1, and a second terminal of the first resistor R1 is connected to the first electrode of the first diode D1.

A first terminal of the second resistor R2 is connected to the second electrode of the second diode D2, and a second terminal of the second resistor R2 is connected to the second voltage terminal V2.

For example, a resistance of the first resistor R1 and a resistance of the second resistor R2 can be designed according to actual application requirements, and the resistance of the first resistor R1 and the resistance of the second resistor R2 can be the same or different, and the present disclosure is not limited to this case.

In addition, as shown in FIGS. 4 and 5, the writing sub-circuit 10 includes a third transistor T3. A gate electrode of the third transistor T3 is connected to the scan signal terminal SC to receive the scan signal, a first electrode of the third transistor T3 is connected to the signal input terminal VD, and a second electrode of the third transistor T3 is connected to the amplification sub-circuit 20.

For example, in the example as shown in FIG. 4, the second electrode of the third transistor T3 is connected to the gate electrode of the first transistor T1 and the gate electrode of the second transistor T2. In the example as shown in FIG. 5, the second electrode of the third transistor T3 is connected to both the second electrode of the first diode D1 and the first electrode of the second diode D2.

In addition, the drive sub-circuit 30 further includes a fourth transistor T4, which is configured to provide a drive current to the light-emitting device 40 under control of the data voltage stored on the storage capacitor Cst. A gate electrode of the fourth transistor T4 is connected to the amplification sub-circuit 20 and the first terminal of the storage capacitor Cst, a first electrode of the fourth transistor T4 is connected to the third voltage terminal V3, and a second electrode of the fourth transistor T4 is connected to the light-emitting device 40.

For example, in a case where the light-emitting device 40 is the light-emitting diode D3, the second electrode of the fourth transistor T4 may be connected to the anode of the light-emitting diode D3.

It should be noted that the third transistor T3 and the fourth transistor T4 may be N-type transistors or P-type transistors, and the present disclosure is not limited thereto. In FIGS. 4 and 5, the embodiments of the present disclosure are described by taking a case that the third transistor T3 and the fourth transistor T4 are P-type transistors as examples.

It should be noted that the transistors used in the embodiments of the present disclosure may be thin film transistors or field effect transistors or other switch devices with the same characteristics, and the thin film transistors may include oxide thin film transistors, amorphous silicon thin film transistors or polysilicon thin film transistors, etc. A source electrode and a drain electrode of the transistor can be symmetrical in structure, so the source electrode and the drain electrode of the transistor can be indistinguishable in physical structure. In the embodiments of the present disclosure, in order to distinguish two electrodes of the transistor except a gate electrode, as a control electrode, one of the two electrodes is referred to as a first electrode described directly, and the another is referred to as a second electrode, so first electrodes and second electrodes of all or part of the transistors in the embodiment of the present disclosure can be interchanged if necessary.

For example, according to characteristics of transistors, the transistors can be divided into N-type transistors and P-type transistors. For the sake of clarity, the embodiment of the present disclosure describes the technical solution of the present disclosure by taking a case that the second transistor T2, the third transistor T3, and the fourth transistor T4 are all P-type transistors (e.g., P-type MOS transistors) and the first transistor T1 is N-type transistors (e.g., N-type MOS transistors) as an example in detail, however, the transistors of the embodiment of the present disclosure are not limited to P-type transistors, those skilled in the art can also realize the functions that the second transistor T2, the third transistor T3 and the fourth transistor T4 in the embodiment of the present disclosure are implemented by N-type transistors and the functions that the first transistor T1 in the embodiment of the present disclosure is implemented by P-type transistor, according to actual needs.

For example, the first electrode of any one of the first transistor T1, the second transistor T2, the third transistor T3, and the fourth transistor T4 may be a drain electrode, the second electrode may be a source electrode, or the first electrode of any one of the transistors may be a source electrode, and the second electrode may be a drain electrode.

Figure 6:
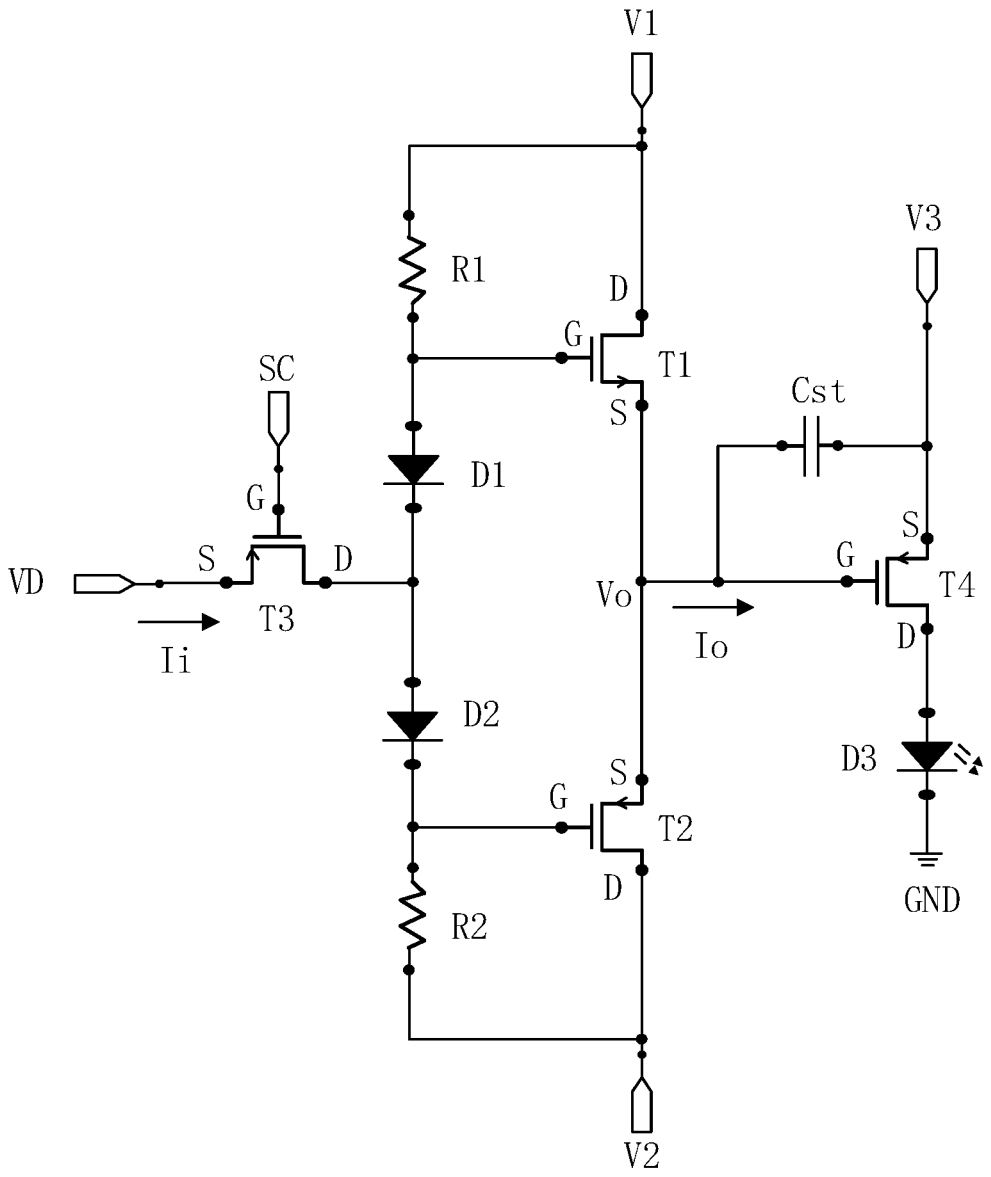
FIG. 6 is an operation schematic diagram of the pixel drive circuit as shown in FIG. 5.

For example, as shown in FIG. 6, the first electrodes of the second transistor T2, the third transistor T3 and the fourth transistor T4, which are P-type transistors, are source electrodes(S), the second electrodes of the second transistor T2, the third transistor T3 and the fourth transistor T4, which are P-type transistors, are drain electrodes (D). The first electrode of the first transistor T1, which is an N-type transistor, is a drain electrode (D), the second electrode of the first transistor T1, which is an N-type transistor, is a source electrode (S).

It should be noted that the writing sub-circuit 10, the amplification sub-circuit 20 and the drive sub-circuit 30 are not limited to the structures described in the above embodiment, and the specific structures thereof can be set according to actual application requirements. In addition, according to actual requirements, the pixel drive circuit 100 may further include a light-emitting control sub-circuit, a compensation sub-circuit, a reset sub-circuit, etc. The embodiment of the present disclosure does not limit the specific structure of the pixel drive circuit 100.

A control method of the pixel drive circuit 100 will be described below by taking the structure of the pixel drive circuit as shown in FIG. 5 as an example.

Figure 7:
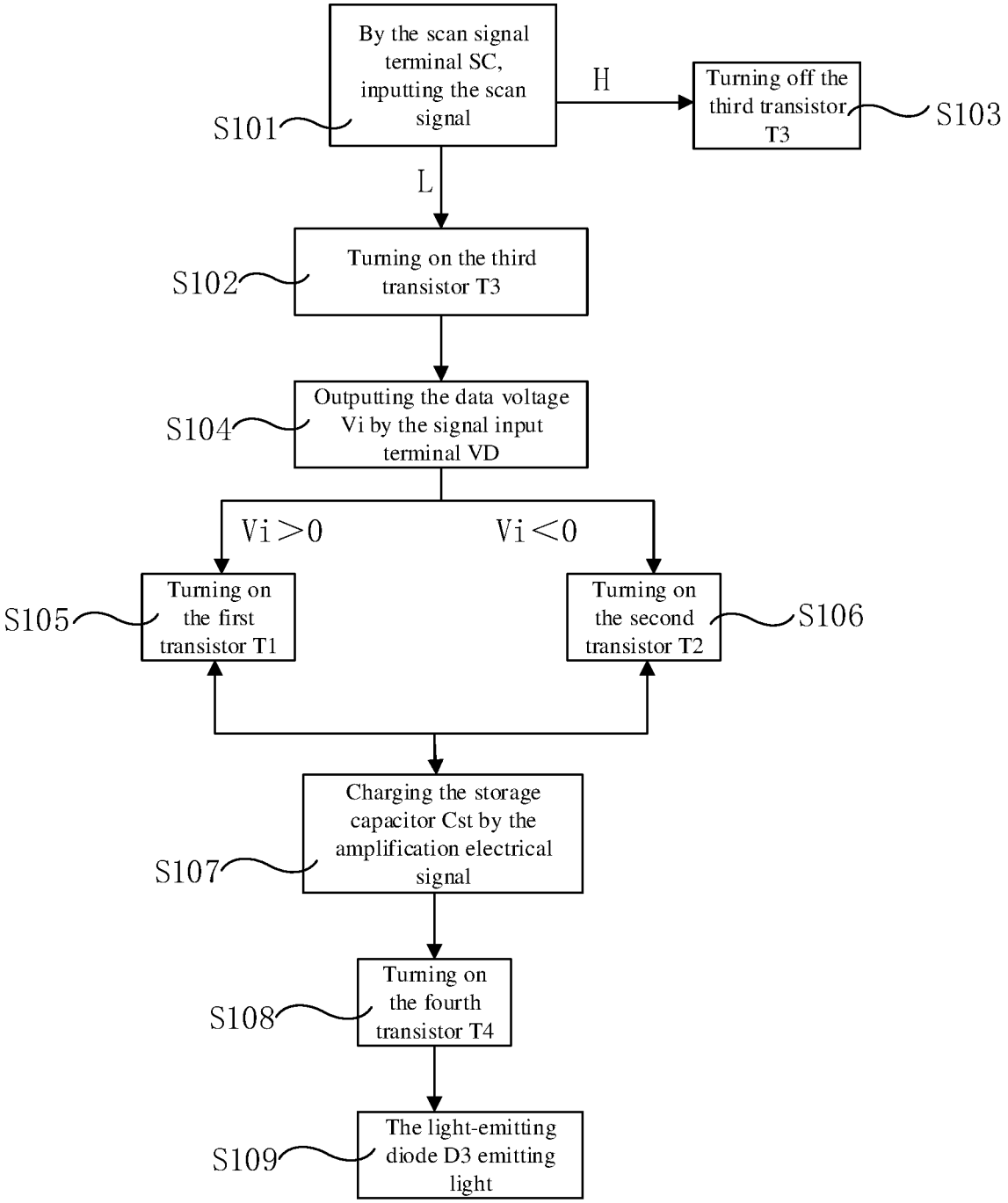
FIG. 7 is an operation flowchart of the pixel drive circuit as shown in FIG. 5.

For example, as shown in FIG. 7, the control method of the pixel drive circuit 100 includes:

S101, inputting the scan signal by the scan signal terminal SC.

For example, as shown in FIG. 6, the scan signal input from the scan signal terminal SC is input to the gate electrode (G) of the third transistor T3. A case that the third transistor T3 is a P-type transistor is taken as an example. In a case where the scan signal input from the scan signal terminal SC is at a low level (L), step S102 is executed. In a case where the scan signal input from the scan signal terminal SC is at a high level (H), step S103 is executed.

S102, in a case where the scan signal is at a low level (L), turning on the third transistor T3 under control of the scan signal.

At this time, because the third transistor T3 is in a saturated turn-on state, as shown in FIG. 6, a voltage Vs of the source electrode of the third transistor T3 is identical to a voltage Vd of the drain electrode of the third transistor T3.

S103, in a case where the scan signal is at a high level (H), turning off the third transistor T3 under control of the scan signal.

S104, outputting the data voltage Vi by the signal input terminal VD.

For example, the data voltage Vi is output to the first electrode (i.e., the source electrode S) of the third transistor T3.

For example, as shown in FIGS. 5 and 6, because the amplification sub-circuit 20 is provided with the first diode D1 which is configured to cancel the threshold voltage of the first transistor T1, and the second diode D2 which is configured to cancel the threshold voltage of the second transistor T2.

Therefore, in a case where the data voltage Vi>0, step S105 is executed, and the first transistor T1 is turned on. At this time, the first transistor T1 is in the amplification region and the second transistor T2 is turned off, that is, the second transistor T2 is in the off region.

Alternatively, in a case where the data voltage Vi<0, step S106 is executed, and the second transistor T2 is turned on. At this time, the second transistor T2 is in the amplification region and the first transistor T1 is turned off, i.e., the first transistor T1 is in the off region.

After the first transistor T1 or the second transistor T2 is turned on, the first transistor T1 or the second transistor T2 generates the amplification electrical signal, which is transmitted to the drive sub-circuit 30.

S107, charging the storage capacitor Cst by the amplification electrical signal.

At this time, the voltage Vo stored on the storage capacitor Cst is equal to Vi. For example, the amplification electrical signal output by the amplification sub-circuit 20 may be a current, and the current Io output by the amplification sub-circuit 20 is equal to A×Ii, where A is a current amplification multiple of the amplification sub-circuit 20, and A is greater than 1. The value of A is related to a process parameter of the first transistor T1 and a process parameter of the second transistor T2. For example, the process parameter may include a base thickness, a base area, and a doping concentration, etc. For example, the value of A is proportional to a base area of the first transistor T1 and a base area of the second transistor T2.

For example, a charge Q stored on the storage capacitor Cst satisfies the following formula:

$$Q=Io\times t=A\times Ii\times t=A\times t\times\int Ii(t)dt$$

where t is the charging time of the storage capacitor Cst.

In addition, because Q=Cst×Vgs; where Cst is a capacitance value of the storage capacitor Cst, and Vgs is a gate-source voltage of the fourth transistor T4.

Therefore, the charging time t=Cst×Vgs/(A×∫Ii(t)dt) . . . (1).

From the formula (1), it can be seen that the charging time t of the storage capacitor Cst is inversely proportional to the current amplification multiple A of the amplification sub-circuit 20. In a case where the pixel drive circuit 100 does not include the amplification sub-circuit 20, the storage circuit Cst is directly charged by using the current Ii, which corresponds that A is 1 at this time. In a case where the pixel drive circuit 100 does not include the amplification sub-circuit 20, the storage circuit Cst is charged by using the current Io, and the storage circuit Cst needs to be charged to the data voltage Vi. Because the current Io is greater than the current Ii, the charging time of the storage capacitor Cst can be reduced. Therefore, under control of the amplification sub-circuit 20, the charging time of the storage capacitor Cst can be effectively reduced, and the problem that the charging time of the storage capacitor Cst is longer in a case where the data voltage provided by the writing sub-circuit is smaller can be solved.

For example, in a case where the storage capacitor Cst is charged to a certain stage (i.e., the voltage stored on the storage capacitor Cst (i.e., Vgs) is greater than a threshold voltage of the fourth transistor T4), step S108 is executed, and the fourth transistor T4 is turned on.

For example, after the storage circuit Cst is finished to be charged, the voltage stored on the storage circuit Cst is identical to the data voltage Vi.

For example, after the fourth transistor T4 is turned on, a conductive path from the third voltage terminal V3 to the grounded terminal GND may be formed. According to a current formula of the fourth transistor T4, the drive current $I_{D3}$ flowing through the fourth transistor T4 can be expressed as:

$$I_{D3}=\tfrac{1}{2}K(Vgs-Vth1)$$

where K is a process constant of the fourth transistor T4, Vgs is a voltage stored on the storage capacitor Cst, and Vth1 is the threshold voltage of the fourth transistor T4. For example, K can be expressed as:

$$K=0.5\mu_n C_{ox}(W/L),$$

where $\mu_n$ is an electron mobility of the fourth transistor T4, Cox is a gate unit capacitance of the fourth transistor T4, W is a channel width of the fourth transistor T4, and L is a channel length of the fourth transistor T4.

S109, under the drive of the drive current, the light-emitting diode D3 emitting light.

Figure 8:
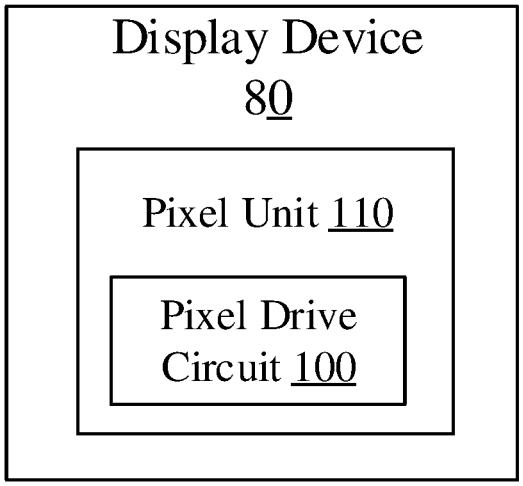
FIG. 8 is a schematic block diagram of a display device provided by some embodiments of the disclosure.

At least some embodiments of the present disclosure also provide a display device, and FIG. 8 is a schematic block diagram of a display device provided by some embodiments of the present disclosure.

For example, as shown in FIG. 8, the display device 80 includes any one of the pixel drive circuits 100 described above. For example, the display device 80 has the same technical effect as the pixel drive circuit provided in the above embodiment, and will not be described here again.

For example, the display device 80 includes a plurality of pixel units 110, and the plurality of pixel units 110 may be arranged in an array. According to actual application requirements, the display device 80 may include, for example, 1440 rows and 900 columns of pixel units 110. Each pixel unit 110 may include the pixel drive circuit 100 described in any one of the above embodiments.

It should be noted that in the embodiment of the present disclosure, the display device 80 can be any product or component with display function such as a display, a television, a digital photo frame, a mobile phone or a tablet computer.

For example, the display device 80 may further include a gate driver. The gate driver is also configured to be electrically connected to the writing sub-circuit in the pixel drive circuit 100 through a plurality of gate lines for providing scan signals to the writing sub-circuit.

For example, the display device 80 may also include a data driver. The data driver is configured to provide a data signal to the pixel drive circuit 100. The data signal may be a voltage signal, which is used for controlling a light-emitting intensity of the light-emitting device of a corresponding pixel unit 110. The higher the voltage of the data signal, the larger the gray scale, so that the light-emitting intensity of the light-emitting device is larger.

It should be noted that other components of the display device 80 (e.g., control device, image data encoding/decoding device, clock circuit, etc.) should be included, which is understood by those of ordinary skill in the art, and are not described in detail herein again, nor should they be taken as limitations to the present disclosure.

The embodiment of the present disclosure also provides a drive method of the pixel drive circuit, which can be applied to the pixel drive circuit described in any one of the above embodiments.

Figure 9:
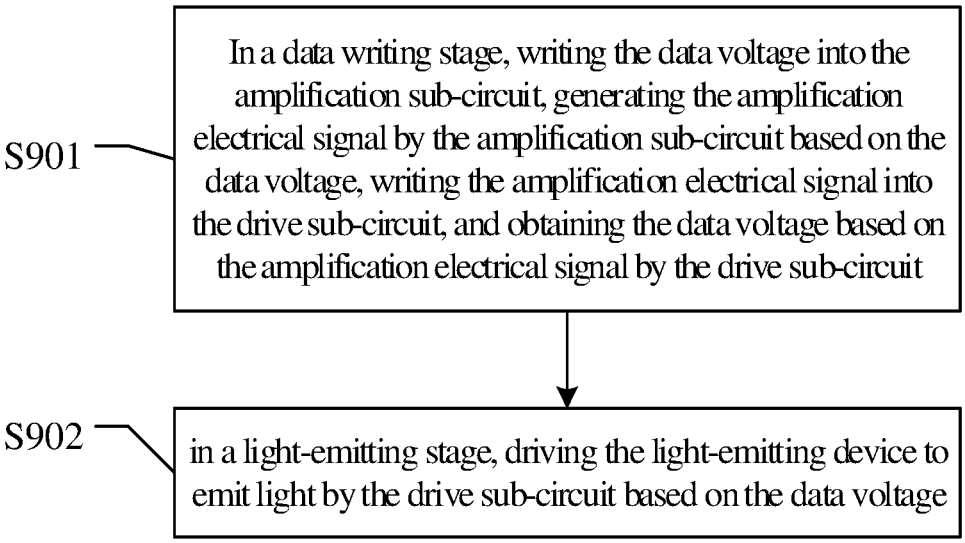
FIG. 9 is a schematic flowchart of a drive method of a pixel drive circuit provided by some embodiments of the disclosure.

FIG. 9 is a schematic flowchart of a drive method of a pixel drive circuit provided by an embodiment of the present disclosure. As shown in FIG. 9, the drive method of the pixel drive circuit includes the following steps:

Step S901: in a data writing stage, writing the data voltage into the amplification sub-circuit, generating the amplification electrical signal by the amplification sub-circuit based on the data voltage, writing the amplification electrical signal into the drive sub-circuit, and obtaining the data voltage based on the amplification electrical signal by the drive sub-circuit; and Step S902: in a light-emitting stage, driving the light-emitting device to emit light by the drive sub-circuit based on the data voltage.

It should be noted that the detailed description of step S901 and step S902 may refer to the above description of FIG. 7, and the repetition will not be repeated here again.

The above description is only a specific embodiment of the present disclosure, but the scope of protection of the present disclosure is not limited to this case. Any person familiar with the technical field can easily think of changes or substitutions within the technical scope of the present disclosure, and should be covered within the scope of protection of the present disclosure. Therefore, the scope of protection of the present disclosure should be based on the scope of protection of the claims.

What is claimed is:

1. A pixel drive circuit, comprising a writing sub-circuit, an amplification sub-circuit, and a drive sub-circuit, wherein the writing sub-circuit is connected to a scan signal terminal, a signal input terminal, and the amplification sub-circuit, and the writing sub-circuit is configured to transmit a data voltage provided by the signal input terminal to the amplification sub-circuit under control of the scan signal terminal;

the amplification sub-circuit is also connected to the drive sub-circuit, and the amplification sub-circuit is configured to generate an amplification electrical signal according to the data voltage and output the amplification electrical signal to the drive sub-circuit;

the drive sub-circuit is also connected to a light-emitting device, and the drive sub-circuit is configured to obtain the data voltage based on the amplification electrical signal output by the amplification sub-circuit and provide a drive current to the light-emitting device under control of the data voltage, and the light-emitting device is configured to emit light according to the drive current, wherein the amplification sub-circuit comprises a first transistor and a second transistor;

a gate electrode of the first transistor is connected to the writing sub-circuit, a first electrode of the first transistor is connected to a first voltage terminal, and a second electrode of the first transistor is connected to a first electrode of the second transistor and the drive sub-circuit; and a gate electrode of the second transistor is connected to the writing sub-circuit, a second electrode of the second transistor is connected to a second voltage terminal, and the first electrode of the second transistor is connected to the drive sub-circuit.

2. The pixel drive circuit according to claim 1, wherein a first voltage output by the first voltage terminal is greater than a second voltage output by the second voltage terminal, the first transistor is an N-type transistor, and the second transistor is a P-type transistor; or the first voltage output by the first voltage terminal is less than the second voltage output by the second voltage terminal, and the first transistor is the P-type transistor and the second transistor is the N-type transistor.

3. The pixel drive circuit according to claim 2, wherein an absolute value of the first voltage is identical to an absolute value of the second voltage.

4. The pixel drive circuit according to claim 1, wherein an absolute value of a threshold voltage of the first transistor is identical to an absolute value of a threshold voltage of the second transistor.

5. The pixel drive circuit according to claim 1, wherein the amplification sub-circuit further comprises a first diode and a second diode;

a first electrode of the first diode is connected to the gate electrode of the first transistor, and a second electrode of the first diode is connected to the writing sub-circuit; and a first electrode of the second diode is connected to the writing sub-circuit, and a second electrode of the second diode is connected to the gate electrode of the second transistor.

6. The pixel drive circuit according to claim 5, wherein a forward conduction voltage of the first diode is identical to an absolute value of a threshold voltage of the first transistor; and a forward conduction voltage of the second diode is identical to an absolute value of a threshold voltage of the second transistor.

7. The pixel drive circuit according to claim 5, wherein the amplification sub-circuit further comprises a first resistor and a second resistor;

a first terminal of the first resistor is connected to the first voltage terminal, and a second terminal of the first resistor is connected to the first electrode of the first diode; and a first terminal of the second resistor is connected to the second electrode of the second diode, and a second terminal of the second resistor is connected to the second voltage terminal.

8. The pixel drive circuit according to claim 1, wherein the writing sub-circuit comprises a third transistor; and a gate electrode of the third transistor is connected to the scan signal terminal, a first electrode of the third transistor is connected to the signal input terminal, and a second electrode of the third transistor is connected to the amplification sub-circuit.

9. The pixel drive circuit according to claim 1, wherein the drive sub-circuit comprises a storage capacitor and a fourth transistor;

the storage capacitor is configured to obtain and store the data voltage based on the amplification electrical signal output by the amplification sub-circuit; and the fourth transistor is configured to provide the drive current to the light-emitting device under control of the data voltage.

10. The pixel drive circuit according to claim 9, wherein a first terminal of the storage capacitor is connected to the amplification sub-circuit to receive the amplification electrical signal, and a second terminal of the storage capacitor is connected to a third voltage terminal; and a gate electrode of the fourth transistor is connected to the amplification sub-circuit and the first terminal of the storage capacitor, a first electrode of the fourth transistor is connected to the third voltage terminal, and a second electrode of the fourth transistor is connected to the light-emitting device.

11. The pixel drive circuit according to claim 1, wherein the light-emitting device comprises a light-emitting diode; and an anode of the light-emitting diode is connected to the drive sub-circuit, and a cathode of the light-emitting diode is connected to a fourth voltage terminal.

12. A display device, comprising a pixel drive circuit, wherein the pixel drive circuit comprises a writing sub-circuit, and a drive sub-circuit, wherein the writing sub-circuit is connected to a scan signal terminal, a signal input terminal, and the amplification sub-circuit, and the writing sub-circuit is configured to transmit a data voltage provided by the signal input terminal to the amplification sub-circuit under control of the scan signal terminal;

the amplification dub-circuit is also connected to the drive sub-circuit, and the amplification sub-circuit is configured to generate an amplification electrical signal according to the data voltage and output the amplification electrical signal to the drive sub-circuit;

the drive sub-circuit is also connected to a light-emitting device, and the drive sub-circuit is configured to obtain the data voltage base don the amplification electrical signal output by the amplification sub-circuit and provide a drive current to the light-emitting device under control of the data voltage; and the light-emitting device is configured to emit light according to the drive current, wherein the amplification sub-circuit comprises a first transistor and a second transistor;

a gat electrode of the second transistor is connected to the writing sub-circuit, a first electrode of the first transistor is connected to a first voltage terminal, and a second electrode of the first transistor is connected to a first electrode of the second transistor and the drive sub-circuit; and a gate electrode of the second transistor is connected to the writing sub-circuit, a second electrode of the second transistor is connected to a second voltage terminal, and the first electrode of the second transistor is connected to the drive sub-circuit.

13. A method for driving the pixel drive circuit according to claim 1, comprising:

in a data writing stage, writing the data voltage into the amplification sub-circuit, generating the amplification electrical signal by the amplification sub-circuit based on the data voltage, writing the amplification electrical signal into the drive sub-circuit, and obtaining the data voltage based on the amplification electrical signal by the drive sub-circuit; and in a light-emitting stage, driving the light-emitting device to emit light by the drive sub-circuit based on the data voltage.

14. The pixel drive circuit according to claim 2, wherein an absolute value of a threshold voltage of the first transistor is identical to an absolute value of a threshold voltage of the second transistor.

15. The pixel drive circuit according to claim 3, wherein an absolute value of a threshold voltage of the first transistor is identical to an absolute value of a threshold voltage of the second transistor.

16. The pixel drive circuit according to claim 2, wherein the amplification sub-circuit further comprises a first diode and a second diode;

a first electrode of the first diode is connected to the gate electrode of the first transistor, and a second electrode of the first diode is connected to the writing sub-circuit; and a first electrode of the second diode is connected to the writing sub-circuit, and a second electrode of the second diode is connected to the gate electrode of the second transistor.

17. The pixel drive circuit according to claim 3, wherein the amplification sub-circuit further comprises a first diode and a second diode;

a first electrode of the first diode is connected to the gate electrode of the first transistor, and a second electrode of the first diode is connected to the writing sub-circuit; and a first electrode of the second diode is connected to the writing sub-circuit, and a second electrode of the second diode is connected to the gate electrode of the second transistor.

18. The pixel drive circuit according to claim 4, wherein the amplification sub-circuit further comprises a first diode and a second diode;

a first electrode of the first diode is connected to the gate electrode of the first transistor, and a second electrode of the first diode is connected to the writing sub-circuit; and a first electrode of the second diode is connected to the writing sub-circuit, and a second electrode of the second diode is connected to the gate electrode of the second transistor.

19. The pixel drive circuit according to claim 6, wherein the amplification sub-circuit further comprises a first resistor and a second resistor;

a first terminal of the first resistor is connected to the first voltage terminal, and a second terminal of the first resistor is connected to the first electrode of the first diode; and a first terminal of the second resistor is connected to the second electrode of the second diode, and a second terminal of the second resistor is connected to the second voltage terminal.

* * * * *